US006857170B2

(12) United States Patent
Fehrer

(10) Patent No.: US 6,857,170 B2
(45) Date of Patent: Feb. 22, 2005

(54) METHOD FOR TREATING A YARN BY NEEDLING

(76) Inventor: Monika Fehrer, Wegscheider Strasse 15, A 4060 Leonding (AT)

( * ) Notice: Subject to any disclaimer, the term of this patent is extended or adjusted under 35 U.S.C. 154(b) by 147 days.

(21) Appl. No.: 10/183,293

(22) Filed: Jun. 27, 2002

(65) Prior Publication Data

US 2003/0000056 A1 Jan. 2, 2003

(30) Foreign Application Priority Data

Jul. 2, 2001 (AT) ..... A 1017/2001

(51) Int. Cl.[7] ..... D04H 18/00
(52) U.S. Cl. ..... 28/107; 28/247
(58) Field of Search ..... 28/252, 259, 217, 28/218, 107, 108, 109, 110, 111, 112, 113, 114, 115, 165, 103, 247; 57/202, 22, 23

(56) References Cited

U.S. PATENT DOCUMENTS 1,971,124 A * 8/1934 Tudor et al. ..... 19/66 R
3,208,125 A * 9/1965 Hall et al. ..... 28/219
4,445,318 A * 5/1984 Becker et al. ..... 57/22
4,674,271 A 6/1987 Bird
5,081,753 A 1/1992 Fink et al.
5,390,399 A * 2/1995 Dilo ..... 28/109
5,473,802 A * 12/1995 Dilo ..... 28/107
5,758,394 A * 6/1998 Linck et al. ..... 28/107
5,813,101 A * 9/1998 Fehrer ..... 28/114
5,819,383 A * 10/1998 Jourde et al. ..... 28/107
5,893,200 A * 4/1999 Fehrer ..... 28/115
6,305,058 B1 * 10/2001 Fehrer ..... 28/107
6,311,375 B1 * 11/2001 Patrick ..... 28/253
6,385,825 B1 * 5/2002 Wang et al. ..... 28/107
2003/0097740 A1 * 5/2003 Jourde et al. ..... 28/107

* cited by examiner

*Primary Examiner*—Amy B. Vanatta
(74) *Attorney, Agent, or Firm*—Collard & Roe, P.C.

(57) ABSTRACT

In a method for treating a yarn by needling, with the yarn fibers being drawn transversally to the longitudinal direction of the yarn, it is proposed that fibers of a yarn formed from staple fibers are needled in a brush support before the yarn is removed from the brush support.

4 Claims, 3 Drawing Sheets

METHOD FOR TREATING A YARN BY NEEDLING

FIELD OF THE INVENTION

The invention relates to a method for treating a yarn by needling, with the yarn fibers being drawn from the yarn transversally to the longitudinal direction of the yarn.

DESCRIPTION OF THE PRIOR ART

In order to adjust the properties of yarn from filaments to the properties of staple-fiber yarns it is known (U.S. Pat. No. 4,674,271 A, U.S. Pat. No. 5,081,753 A) to subject the yarns to a needling in order to break the filaments. For this purpose the yarn to be treated is pulled lengthwise through a guide channel in the zone of which there is provided a transversal bore for allowing the passage of a needle which can be driven in a reciprocating manner in the needle-penetration direction and which breaks the filaments during the penetration of the yarn and draws out the broken sections transversally from the longitudinal direction of the yarn out of the yarn structure (U.S. Pat. No. 4,674,271 A). In order to use a plurality of needles for treating a yarn made of filaments, the yarn to be treated is guided in a circumferential groove of a disk (U.S. Pat. No. 5,081,753 A) in which needles are disposed behind one another in a radially displaceable manner along the groove, which needles are driven by a cam wheel which is arranged eccentrically with respect to said guide disk in order to penetrate the yarn held in the circumferential groove of the guide disk in the case of a respective relative rotation between guide disk and the cam wheel. Despite these measures to break the fibers, yarns from filaments cannot be compared with yarns from staple fibers. Apart from the fact that the hairiness of staple-fiber yarns is not given, the resistance to tearing of the yarn is reduced considerably by the breaking of the filaments. For this reason such a state of the art cannot give any teachings as to how to proceed when it is intended to increase the hairiness and thus the volume of staple-fiber yarns without needing to fear any loss of strength as is demanded for fancy yarns.

SUMMARY OF THE INVENTION

The invention is thus based on the object of mechanically treating a staple-fiber yarn in such a way that its hairiness can be increased in the sense of a change of its surface structure without having to accept any loss of strength worth mentioning.

Based on a method for treating a yarn by needling of the kind mentioned above, the invention achieves the object in such a way that fibers of a yarn formed of staple fibers are needled into a brush support before the yarn is removed from the brush support.

By needling a yarn made of staple fibers into a brush support, the formation of a fibrous web on the needle-exit side of the yarn by the introduction of fiber loops drawn from the fiber structure between the bristles of the brush support, with the yarn receiving a velour-like surface structure. Despite these measures the yarn strength is substantially retained because the loss of strength by the extraction of fibers is compensated by the thus linked additional felting of the fiber structure. The fiber loops pulled transversally to the longitudinal direction of the yarn through the yarn not only retain the yarn twist, but also improve the fiber cohesion in the longitudinal direction of the yarn.

The relevant aspect for a successful yarn treatment by needling in a brush support is that a sufficiently dense needle-penetration distribution over the yarn length is ensured. This requires a respective yarn guidance concerning the reciprocatingly drivable needles. Particularly simple guide conditions are obtained in this connection when the yarn is partly pressed into the brush support prior to its needling and is held in the pressed-in state during the needling because in this case special guide measures become superfluous and the yarn course can deviate from a straight line.

In order to perform the yarn needling in accordance with the invention one can assume a conventional needling apparatus with at least one needleboard which is reciprocatingly drivable in the needle-penetration direction, a stitch base which is disposed opposite of the needleboard and a stripping means which is disposed between the stitch base and the needleboard and comprises pass-through openings for the needles of the needleboard. It is merely necessary to provide an endlessly revolving brush belt as a stitch base which forms the brush support for the yarn, so that the needles penetrating the yarn through the stripping means needle respective pile fibers from the same into the brush support. To enable the yarn to be guided in the zone of the needles through the needling apparatus, the stripping means can form a guide channel for the yarn extending in the direction of rotation of the brush belt, with the pass-through openings of the stripping means for the needles being disposed in the zone of the guide channel.

As has already been explained above, such guide measures for the yarn can be omitted when the yarn finds a respective guidance in the brush support per se, which requires pressing the yarn into the brush support. For this purpose it is only necessary to choose the distance of the surface of the stripping means facing the brush belt smaller than the diameter of the yarn to be needled. The thus obtained lateral guidance of the yarn by the endlessly revolving brush belt allows a yarn course which departs from the direction of rotation of the brush belt, leading to the advantage that the strain on the brush belt by the needles is not merely limited to a narrow strip of bristles. Needles must be provided however in a sufficient distribution density in the zone of extension of the yarn transversally to the direction of rotation of the brush belt.

To ensure that the yarn to be treated can be placed on the brush belt with a respective lateral component to the direction of rotation of the brush belt, the stripping means can be provided upstream with a traversing device for the yarn. Although said traversing device can be arranged differently, particularly simple constructional conditions are obtained when it consists of a traversing roller with a circumferential groove for receiving the yarn, which circumferential groove is inherently closed and is disposed in a plane inclined at an acute angle to the roller axis. The axial extension of said circumferential groove along the roller axis thus determines the transversal displacement of the yarn with respect to the direction of rotation of the brush belt.

BRIEF DESCRIPTION OF THE DRAWINGS

The method in accordance with the invention is now explained in closer detail by reference to the enclosed drawings, wherein.

DESCRIPTION OF THE PREFERRED EMBODIMENTS

Figure 1:
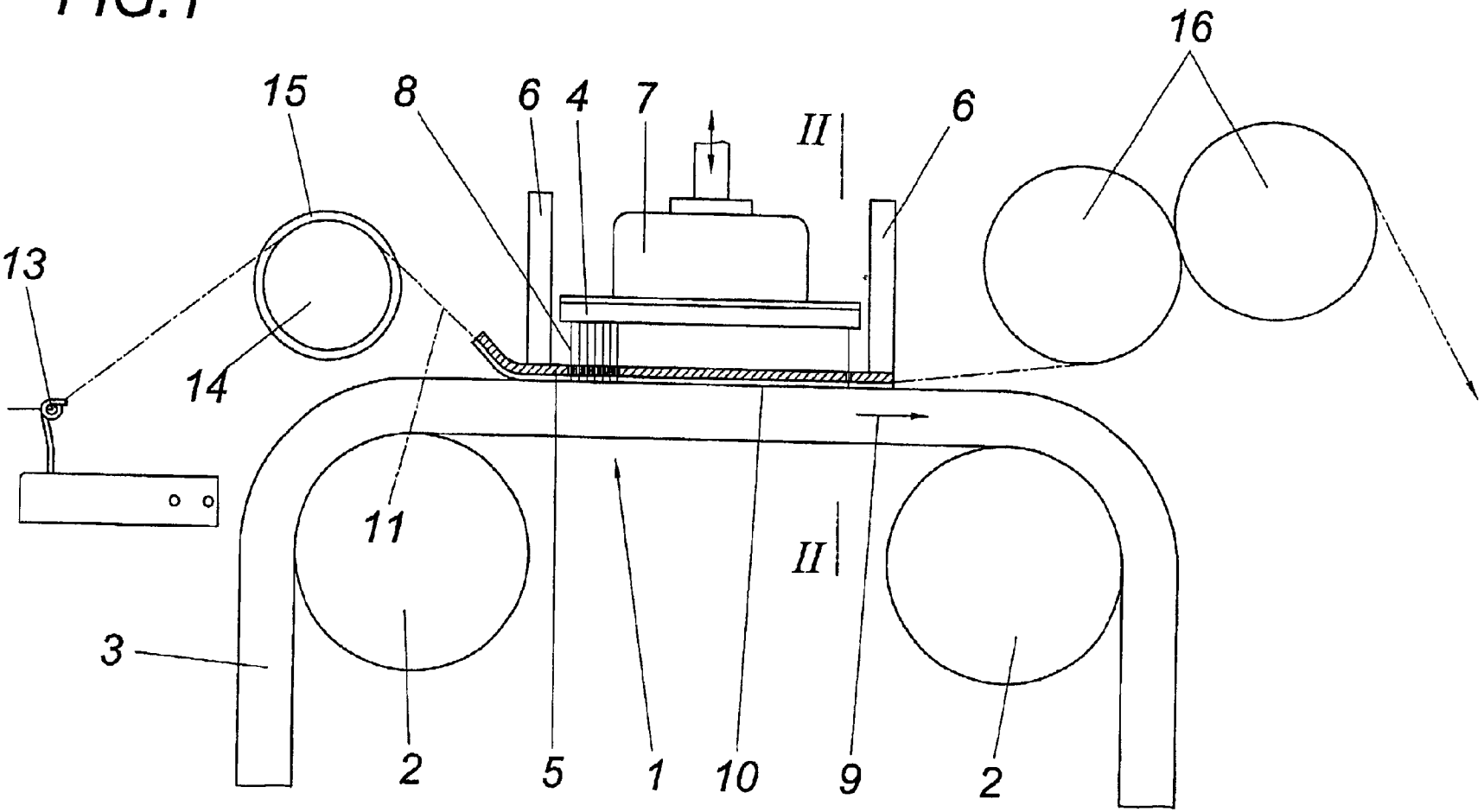
FIG. 1 shows an apparatus in accordance with the invention for needling a yarn in a partly elevated schematic side view.
Figure 2:
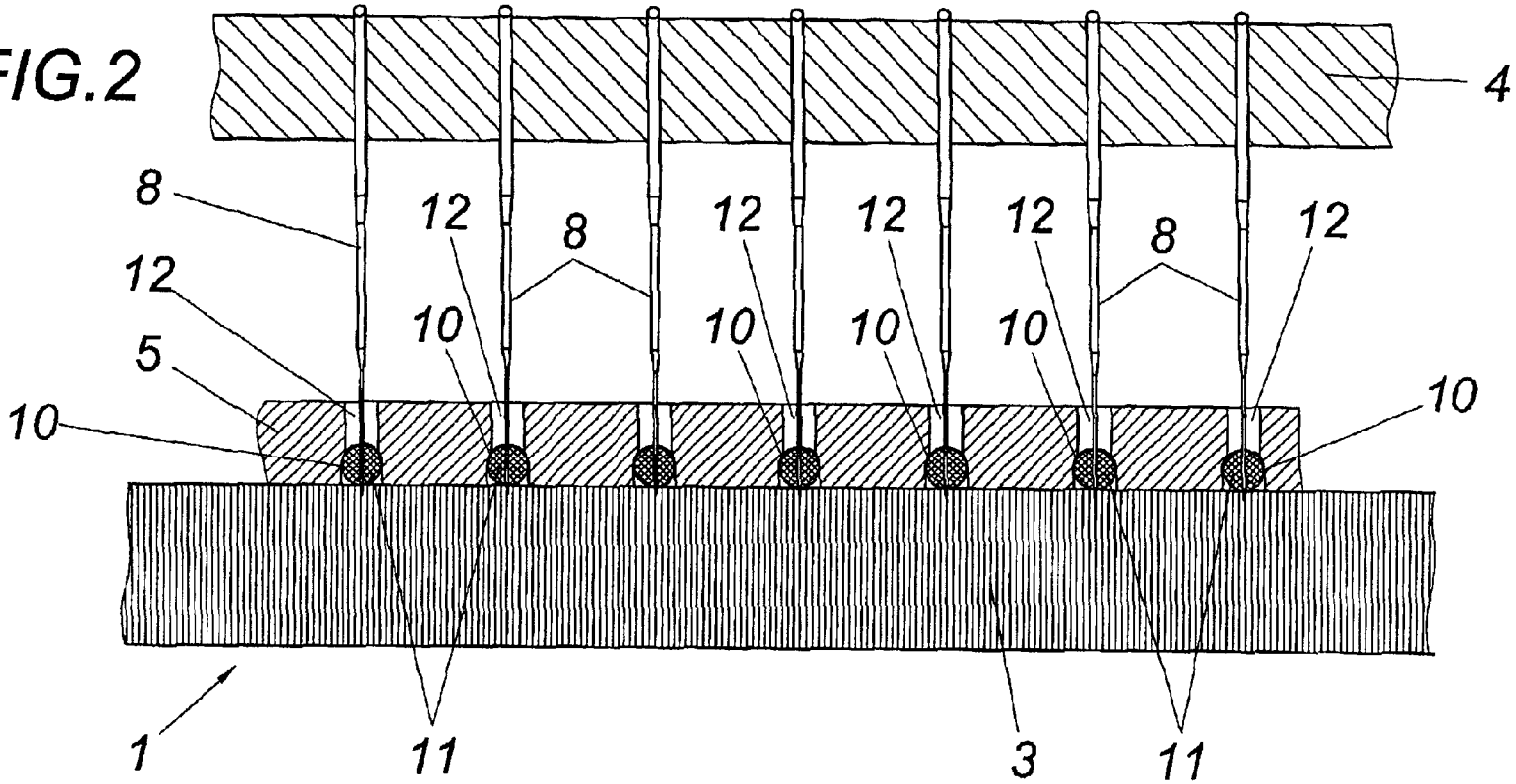
FIG. 2 shows a sectional view along line II—II of FIG. 1 on an enlarged scale.

The apparatus according to FIGS. 1 and 2 substantially consists of a stitch base 1 which is formed by a brush belt 3 guided continuously about deflection rollers 2, a needleboard 4 disposed opposite of the stitch base 1 and a stripping means 5 which is provided between the stitch base 1 and the needleboard 4 and whose distance from the stitch base 1 can be set via supports 6. The needleboard 4 which is inserted in a conventional manner in a needle beam 7 is reciprocatingly driven via the needle beam 7 by means of an eccentric drive in the needle-penetration direction of the needles 8.

In contrast to conventional stripping means, the stripping means 5 according to the embodiment of FIGS. 1 and 2 is provided on the side facing the brush belt 3 with guide channels 10 extending in the direction of rotation 9 for yarns 11 supplied parallel next to one another to the stitch base 1. In the zone of said guide channels 10 the needleboard 4 carries rows of needles, with the needles 8 of said rows of needles penetrating the stripping means 5 in the pass-through openings 12 which are disposed in the zone of the guide channels 10, so that the needles 8 penetrate the yarns 11 received by the guide channels 10 and needle fibers in a loop-forming manner into the brush support formed by the brush belt 3, as is shown in FIG. 2. The parallel yarns 11 are drawn off from supply coils and fed via guide eyes 13 to a draw-in roller 14 which is provided with guide grooves 15 which are aligned with respect to the guide channels 10 of the stripping means 5 and extend perpendicular to the axis of the draw-in roller 14. The yarns 11 running off the draw-in roller 14 in the needling direction are needled by the needles 8 by formation of a fibrous web on the needle-exit side into the brush support formed by the brush belt 3 before they are lifted from the brush belt 3 via a roller draw-off 16.

Figure 4:
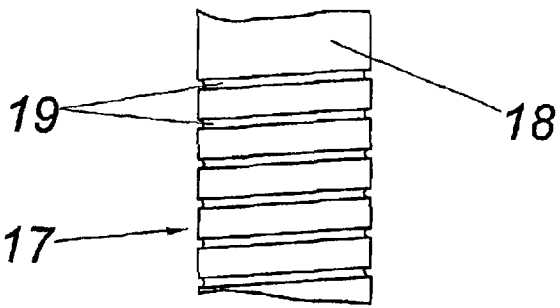
FIG. 4 shows a traversing roller in a sectional top view, which roller is used in an apparatus in accordance with FIG. 3.
Figure 3:
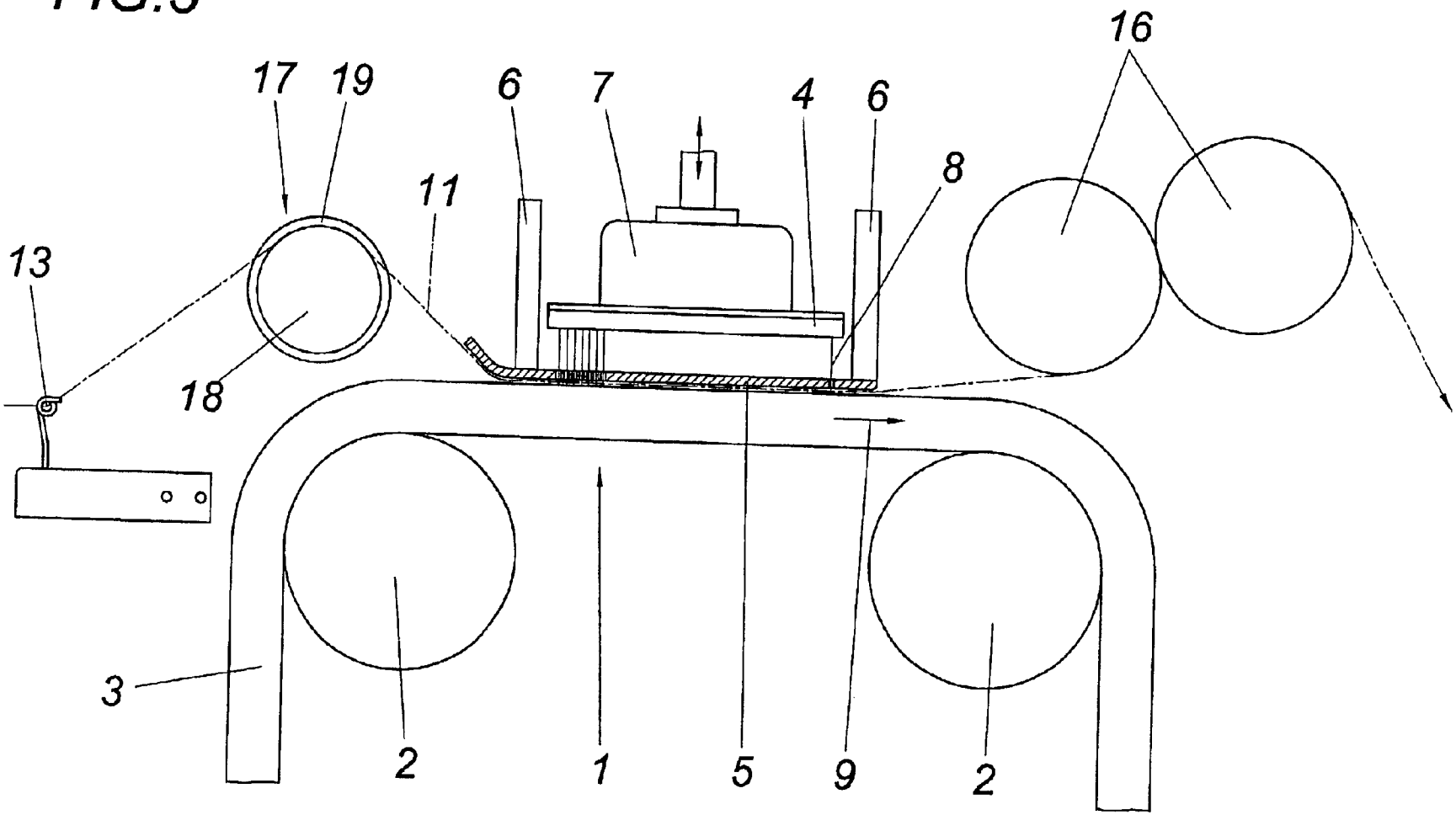
FIG. 3 shows a representation according to FIG. 1 of a constructional variant of a needling apparatus in accordance with the invention.

In contrast to the embodiment according to FIGS. 1 and 2, the stripping means 5 according to FIG. 3 is not provided with any guide channels for the yarns 11. Rather, the yarns 11 are pressed into the brush support via the stripping means 5 and kept pressed in the brush belt 3 during the needling process, so that the bristles of the brush belt 3 assume the lateral guidance of the yarns 11 when they are conveyed with the brush belt 3 in the direction of rotation 9 through the needling apparatus. For this purpose the stripping means 5 must be set via the supports 6 in such a way that the distance of its surface facing the stitch base 1 is smaller from the stitch base 1 than the diameter of the yarns 11. The lateral guidance of the yarns 11 by the brush belt 3 per se allows a yarn course which departs from the direction of rotation 9 of the brush belt 3. For this purpose a traversing device 17 with a traversing roller 18 is provided which comprises inherently closed circumferential grooves 19 for each yarn 11. Said circumferential grooves 19 do not extend perpendicular to the axis of the traversing roller 18, but lie in a plane which is inclined at an acute angle to the roller axis, as is shown in FIG. 4. The yarns supplied via this traversing roller 18 to the needling apparatus are deposited in a reciprocating manner transversally to the direction of rotation 9 of the brush belt 3 according to the axial extension of the circumferential grooves 19, which requires a respective distribution of the needles also transversally to the direction of rotation 9 in order to also ensure the needling of the yarns 11 in their laying zone. The needling per se occurs in the manner already described above. Due to the course of the yarn on the brush belt 3, one must expect a distribution of the needle penetrations over the entire yarn diameter. Such a distribution of needle penetrations can be achieved in an embodiment according to FIGS. 1 and 2 only by a respective transversal offset of the needles within the longitudinal rows of needles.

What is claimed is:

1. An apparatus for treating a yarn by needling, comprising (a) at least one needleboard which is reciprocatingly drivable in a needle-penetration direction, (b) a stitch base which is disposed opposite of the needleboard, the stitch base consisting of (1) an endlessly revolving brush belt forming a brush support for the yarn, (c) a stripping means which is disposed between the stitch base and the needle board, the stripping means having pass-through openings for the needles of the needleboard, and (d) a guide channel for the yarn formed in the stripping means and extending in the direction of rotation of the brush belt, a respective one of the pass-through openings of the stripping means for the needles being disposed in alignment with the guide channel for the yarn.

2. An apparatus for treating a yarn by needling, comprising (a) at least one needleboard which is reciprocatingly drivable in a needle-penetration direction, (b) a stitch base which is disposed opposite of the needleboard, the stitch base consisting of (1) an endlessly revolving brush belt forming a brush support for the yarn, (c) a stripping means which is disposed between the stitch base and the needle board, the stripping means having pass-through openings for the needles of the needleboard, and the distance between the stripping means from the brush belt being smaller than the diameter of the yarn to be needled whereby the yarn is partially pressed into the brush belt and guided therein in alignment with a respective one of the pass-through openings.

3. An apparatus as claimed in claim 2, comprising a traversing device for the yarn upstream of the stripping means.

4. An apparatus as claimed in claim 3, wherein the traversing device consists of a traversing roller with an endless circumferential groove for receiving the yarn, which circumferential groove is disposed in a plane included at an acute angle to the roller axis.

* * * * *